United States Patent [19]

Sander et al.

[11] 4,228,200

[45] Oct. 14, 1980

[54] CONTROLLING METAL COATINGS ON WIRE, STRIP AND THE LIKE EMERGING FROM METAL BATHS

[75] Inventors: Anthony J. Sander, Bonbeach; Jack P. Sciffer, New Lambton; Richard W. Whitton, Cardiff, all of Australia

[73] Assignee: Australian Wire Industries Proprietary Limited, Victoria, Australia

[21] Appl. No.: 962,939

[22] Filed: Nov. 22, 1978

[30] Foreign Application Priority Data

Dec. 15, 1977 [AU] Australia ..... PD2788
May 25, 1978 [AU] Australia ..... PD4509

[51] Int. Cl.[2] ..... B05D 3/14

[52] U.S. Cl. ..... 427/47; 427/331; 427/334; 427/432; 427/433; 427/436; 427/434.6

[58] Field of Search ..... 427/47, 331, 334, 432, 427/433, 434 D, 436

[56] References Cited

U.S. PATENT DOCUMENTS 3,518,109 6/1970 Halley ..... 427/47

FOREIGN PATENT DOCUMENTS 2423598 11/1974 Fed. Rep. of Germany .
5120334 6/1976 Japan .

*Primary Examiner*—Bernard D. Pianalto
*Attorney, Agent, or Firm*—Cushman, Darby & Cushman

[57] ABSTRACT

A method for controlling the coating of wires, strips or the like, emerging from molten metal baths, involving subjecting the wire to a single stationary, alternating electromagnetic field generated by an electromagnetic device positioned at or below the point of emergence such that the point of emergence is always within the electromagnetic field. The frequency and/or current for generating the field may be adjustable, and the field generated by either parallel or transverse to the wire, strip or the like. The wire, strip or the like may pass through, or adjacent, the electromagnetic device. A neutral or reducing atmosphere may be provided within a chamber situated at the point of emergence and the point of emergence covered with particles inert to the environment. Alternatively the emergence area, may be covered by a confined or unconfined bed of oil charcoal. A similar amount of gas or vapor which will decompose to produce a sulphide (−S) radical may be supplied to the protective atmosphere either directly or in addition to the neutral or reducing gas.

13 Claims, 12 Drawing Figures

COATING WEIGHT $gm^{-2}$
500
400
300
200
100
0
100
200
300
400
500
FREQUENCY Hz
30·5 m/min
2·0 AMPS
2·4 mm Wire COATING WEIGHT $-g \cdot m^{-2}$
500
400
300
200
100
0
1·0
2·0
3·0
CURRENT AMPS.
250 Hz
30·5 m/min.
2·4 mm Wire

CONTROLLING METAL COATINGS ON WIRE, STRIP AND THE LIKE EMERGING FROM METAL BATHS

FIELD OF THE INVENTION

The invention relates to the control of metal coatings on wire, strip and the like emerging from metal baths, and particularly, but not exclusively, to wiping hot dipped metal coated wire, strip and the like to produce continuous smooth coatings involving electromagnetic control of the weight of metal coating carried out of the bath by the wire, strip or the like. However, the invention has wider scope in that it may be applied to the reduction of the carry-over of any molten metal from a molten metal bath by wire, strip or the like, e.g., lead carry-over from lead heat treatment baths.

BACKGROUND OF THE INVENTION

Historically, the operation has been performed in the case of wire or mesh by withdrawing the wire or mesh vertically from the molten metal bath through a bed of particulate material with the coating control mechanism acting at the point of emergence of the object. Traditionally, the oiled charcoal process has been used in this way for the production of heavy coatings and more recently, a Gas Wiping Process of the type disclosed in Australian Pat. No. 421,751 has been employed in the galvanizing of steel wire. To achieve thin coatings, tighter wiping techniques are employed such as those utilising asbestos pads pressed hard around the moving wire at its exit from the coating bath.

In the case of strip, two methods have been used to control coatings. The first technique relies on coating rolls rotating in close proximity on the strip near the point of emergence from the coating bath. More recently, jet wiping techniques have been applied to the control of coatings of zinc and zinc/aluminium alloys.

With the exception of jet wiping techniques, these methods suffer from the disadvantage that no rapid and direct coating control mechanism is available.

Although with the known techniques coating weight adjustment is available, it involves other process parameters. For example, in the oiled charcoal wiping process for wire, coating weight on a 2.00 mm wire can be reduced from an average of 300 g/m$^2$ to an average of 250 g/m$^2$ by reducing throughput speed from 20 m/min. to 15 m/min. This raises problems not only of reduced output but with other in-line processes and adjacent products.

In the case of the jet wiping process for strip, which relies on the use of gas streams under pressure to displace molten metal from the surface of the sheet, the large volume of residual gases and the noise inherent with such a process are seen to be serious disadvantages.

In considering the withdrawal of an object from a molten metal bath, various forces act on the entrained liquid film. Of these forces, the significant force in limiting the thickness of the entrained film is the force due to gravity. In the various known commercially applied processes for wire and strip and the like, this force is assisted by additional forces, e.g., pressure from asbestos pads when used, the gas pressure barrier produced when jet wiping is used, and the limiting of gap when coating rolls are used.

As stated earlier, all these additional assisting forces (with the exception of the gas pressure barrier) do not lend themselves to continuous control over a wide range while being capable of small, precise incremental adjustments.

It is an object of this invention to seek to overcome these disabilities by providing a technique which permits the application of an additional assisting force which is capable of precise direct adjustment and monitoring. Through the application of this technique, it is possible to produce a wide range of coating weights approaching the thin coatings as produced by the tight wiping processes up to the heaviest coatings capable of being produced by hot dipped metal coating techniques.

The invention basically involves the application of an electro-magnetic force, by utilising an electromagnetic device (E.M.D.) at and below the point of emergence of the coated wire, strip or the like from the molten metal bath, such that there is inter-action between the device and the system involving both the object and the molten metal during entrainment.

It is recognised that other attempts have been made to utilise electromagnetic forces to alter the molten coating thickness on a moving object. Three prior publications identified are British Pat. No. 1,221,905 granted to Allmanna Svenaka Elektriska Aktienbolaget (A.S.E.A.) German Pat. Application (OLS) No. 2,202,764 in the name of Demag A. G. and Japanese Pat. application No. 69/48599 in the name of Mitsubishi Electric Corporation. In the case of both the A.S.E.A. and Demag publications, the alteration is achieved by imposing a travelling electromagnetic field on the coating after it has formed. In the case of the Mitsubishi application, they also sought to alter the coating by the application of a travelling electromagnetic field both at the point of emergence of the object from the bath, and above.

The present invention differs from the prior art in that it seeks to effect control through the application of a stationary single coil device which is powered by single phase A.C. current to produce an electromagnetic field that acts on the entrained layer moving in the molten metal bath with the object to be coated. This entrained layer is the precursor of the final metal coating. This offers particular advantages in the use of the technique by way of construction of apparatus, compactness of apparatus and simplicity of power generation over previous disclosures.

SUMMARY OF THE INVENTION

The invention therefore envisages a method of controlling metal coatings on wire, strip or the like, emerging substantially vertically from metal baths, said method comprising subjecting said wire, strip or the like to a single, stationary, alternating electromagnetic field applied at, or below, the point of emergence of the coated wire, strip or the like from the molten metal bath with the point of emergence of the wire, strip or the like being within the electromagnetic field.

Preferably the frequency and/or the current of the electrical energy applied to produce the electromagnetic field is variable to exercise control over the coating weight.

In one application of the invention the method is utilised to control the weight of metal coating carried out of a molten metal bath during the production of hot dipped metal coated wire, strip or the like, to produce continuous smooth metal coatings.

In another application of the invention the method is utilised to reduce the carry-over on wire, strip or the like from a molten metal bath.

The electromagnetic field is provided by an electromagnetic device. Electromagnetic devices may be considered as interlinked electric and magnetic circuits and assume a variety of arrangements and configurations. Electromagnetic devices can assume a wide variety of shapes ranging from tubular to flat. The precise shape is not essential to the invention and should not be considered to be limiting thereon.

However, the shape of the object exerts some influence on the most suitable shape of the electromagnetic device. In the case of strip, mesh or multi-wire operations, flat devices are seen to offer particular advantages and are therefore preferred. In the case of a single wire, the device is preferably of a convenient tubular form in which a single coil is arranged so that it surrounds the wire. The flux field may be essentially parallel to the line of travel of the object in one preferred form of the invention or perpendicular in another preferred form of the invention.

The positioning of the electromagnetic device relative to the bath is an important element in achieving greatest efficiency in a practical form of the invention. In accordance with the present invention the device is most effective when located at, or below, the point where the wire, strip or the like emerges from the molten metal bath, and is therefor fully or partially immersed.

It has been observed that when the electromagnetic device is immersed either partially or fully in the bath of molten metal, a secondary advantage is obtained, insofar as the bath of molten metal acts as a heat sink for heat generated due to operation of the electromagnetic device, and thus reduces damage to or deterioration of the electrical windings of the device resulting from excessive overheating which may otherwise occur with increased power input.

It has been found that with immersion the operating temperature of the electromagnetic device is kept close to the temperature of the bath of molten metal.

Furthermore, it has been found that with electromagnetic devices chemical reactions between the windings of the device and certain of the surrounding atmospheres used can cause damage to the windings, such as corrosion. With immersion of the device, it is possible, at least to some extent, to protect the windings from attack by such atmospheres, thus substantially extending the operational life of the electromagnetic device.

A further factor that determines the effectiveness of a preferred form of the invention is the separation between the electromagnetic device and the wire, strip or the like. The effectiveness has been found to increase as the separation gap decreases. In any particular case, the separation gap is influenced by product considerations or other operating constraints.

Work with polyphase linear electric motors of the type utilised in prior art techniques showed that special care is needed to ensure correct sequencing of the phases to achieve the direction of travel of the magnetic field required to produce a wiping action. However, it has been found that with single phase coil devices providing as they do a stationary field in accordance with the present invention, satisfactory wiping is achieved and no sequencing is involved.

Control of coating weight is dependent on the magnitude of the electromagnetic forces exerted by the field generated by the electromagnetic device. The effective force of the device is determined by the power and frequency of the input. We have found that there is an interdependence between power and frequency, so that for a given wiping action, higher power will be required at low frequencies and conversely lower power will be required at high frequencies.

One possible explanation of the behaviour observed in relation to the present invention is as follows.

According to the theory of magnetic induction, the currents induced in, for example a molten zinc coating, by the devices of the present invention, interact with the induction field so that a force is applied to the electrically conductive molten zinc. The direction of the force generated is such that the zinc is repelled from the inducing field. With open-sided devices of the type to be later described with reference to FIGS. 4 and 5 of the drawings, a flow of zinc with a horizontal or counterflow component is produced, in the region immediately below the surface, which essentially interferes with the column of molten zinc entrained by the upward moving wire. This repulsion effect is similar in nature to electromagnetic levitation which is closely related to induction motor theory.

In summary, the effect of the electromagnetic devices utilised in the present invention is to expel molten metal (molten zinc in the case of galvanizing) from the region of the highest flux density to regions of lower flux density.

It has been observed that the frequency of the electrical energy applied to produce the electromagnetic force can be varied to exercise control over the coating weight. In fact, the effectiveness of wiping operation of the electromagnetic device is very much dependent on frequency. At constant current increasing frequency up to about 20 Hz produces little wiping effect. As frequency is increased still further there is a substantial increase in the effectiveness of the wipe up to frequencies of about 500 Hz. Above this value the rate of increase in effectiveness, as distinct from the effectiveness, diminishes.

It has been found that, for a given frequency, increasing the current produces an increase in wiping action and this has been found to be the most convenient means of controlling the coating weight, and thus is preferred.

It is a further preferred feature of the invention to also provide, at the surface of the withdrawal area of the molten metal bath, conditions which eliminate or prevent the formation of substantial amounts of oxidised products. This is achieved by the introduction of gases inert or reducing to the metal(s) involved in the coating process.

In one practical form incorporating this preferred feature of the invention a gas vapour mixture of gases and vapours is supplied within a jacket surrounding the electromagnetic device and the withdrawal point. The specific manner of the addition is not important, provided a small positive pressure is maintained within the jacket. A particular bed or layer, which is inert under the conditions existing within the jacket, may provide benefits by assisting in the distribution of the atmospheres previously described.

Additionally, to maximise throughput speed, it has been found advantageous, in a preferred form of the invention, to stabilise the surface of the molten coating after it has achieved equilibrium thickness by establishing conditions which favour the formation of thin, coherent surface films, e.g., zinc sulphide film in the case of galvanising, or very thin aluminium oxide film for aluminium alloys. Preferably these conditions are provided either by adjustment of the previously mentioned atmosphere, or by the separate subsequent addition within the jacket of specially prepared atmospheres as soon as possible after equilibrium of the coating thickness is achieved, e.g. $H_2S$ or other gases which contain or decompose to produce the sulphide radical in the case of zinc.

DESCRIPTION OF THE PREFERRED EMBODIMENTS

Figure 1:
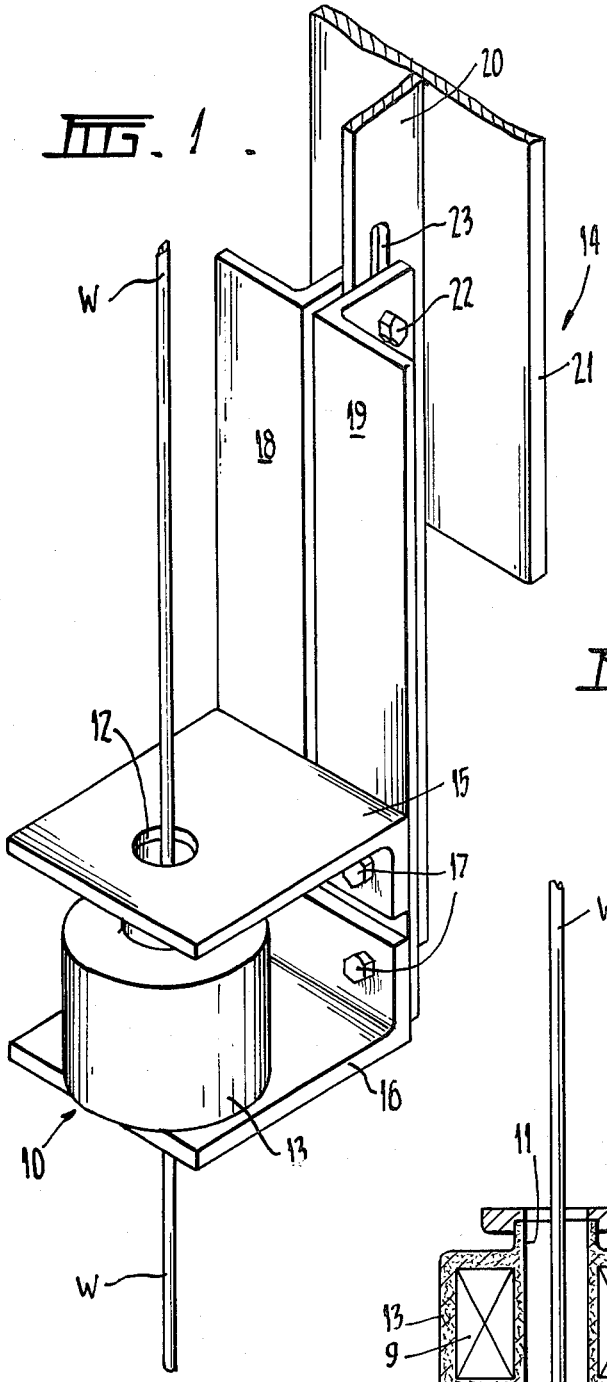
FIG. 1, is a general perspective view of the apparatus of this preferred form of the invention as applied to controlling the weight of a metal coating formed on the surface of a single strand of steel wire emerging from a molten bath of the coating metal.
Figure 2:
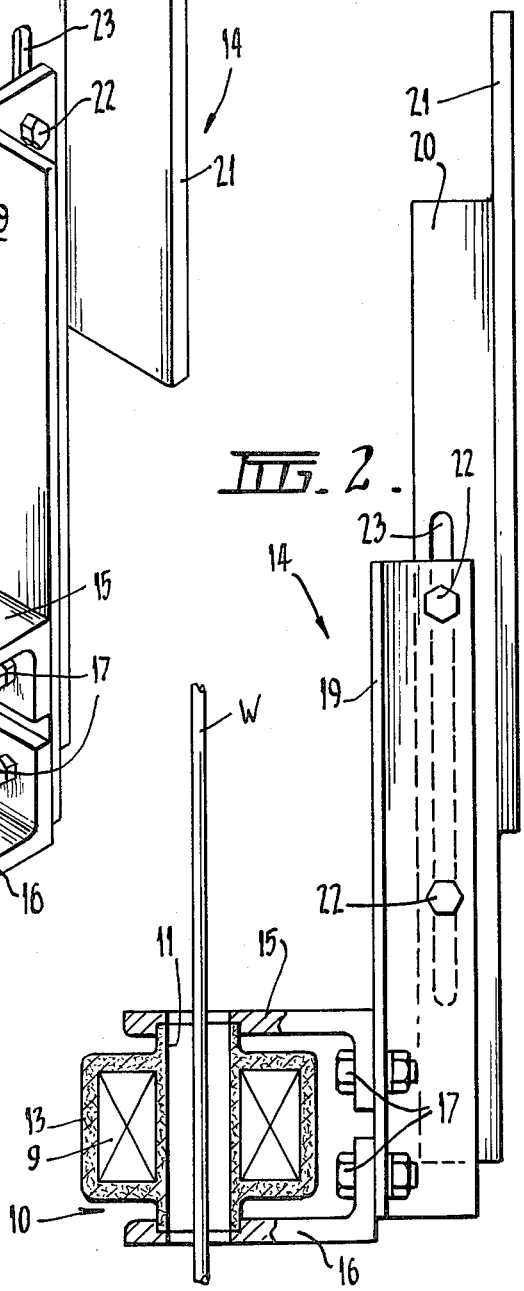
FIG. 2, is a sectioned side elevational view of the apparatus of FIG. 1.

In the preferred form of the invention of FIGS. 1 and 2, as applied in a single form to controlling the coating weight on a single strand of wire (W) emerging from a bath of molten metal, a tubular arrangement of the coil is employed as the electromagnetic device (E.M.D.) (10). The coil (9) surrounds a ceramic tube (11) which defines a passage (12) for a single strand of wire (W) as it moves upwardly out of the metal bath (not shown). The coil (9) is covered with a layer (13) of insulating ceramic material.

The power supply for the device can be by means known to the art that would be fitted with means to vary frequency and current.

An E.M.D. of the type shown in FIGS. 1 and 2 has been subjected to a trial and for the purposes of the trial the device used had a 20 mm bore, 65 mm outside diameter and was 50 mm long. The coil (9) was wound with 300 turns.

For the purposes of the trial a bracket arrangement (14) was utilised, which in effect is equivalent to a mounting bracket arrangement for suspending the E.M.D. over, or in, a molten metal bath in a commercial version of the equipment. The bracket arrangement (14) comprises upper and lower support plates (15) and (16) bolted at (17) to a pair of angle section members (18) and (19), spaced apart to provide a gap within which is received a member (20) forming part of a main support structure (21). Bolted connections (22) cooperate with a slot (23) in the member (20) to allow adjustment of the height of the E.M.D. (10) relative to the molten metal bath adjacent which the main support structure (21) is located. The mean coating weight applied to samples of wire used in the trial was derived by gravimetric analysis. Advantage was also taken during the trial to examine the effect of varying power and frequency. The trials were primarily conducted with the wire path coincident with the principal axis of the E.M.D. During the trial the withdrawal area was protected from gross oxidation by the combined intermittent use of ammonium chloride and continuous hydrogen/nitrogen gas flushing. For the purposes of the trial the apparatus was incorporated within a conventional galvanising line in which the wire samples were coated with zinc from the molten metal bath. Furthermore in the trial the samples utilised were, 2.4 mm wires pretreated through lead baths.

Figure 3A:
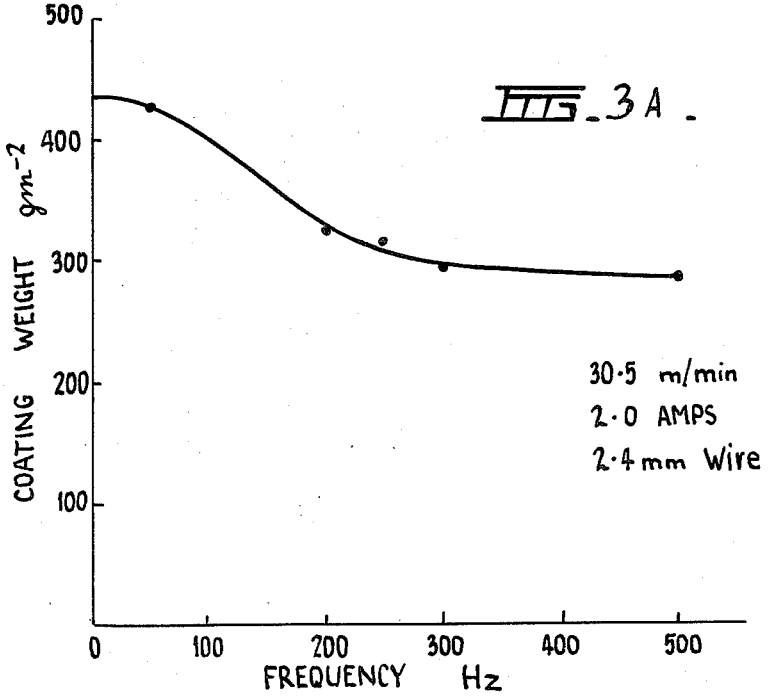
FIGS. 3A and 3B are graphical representations of the results of trials conducted, employing frequencies of up to 500 Hz, using the apparatus of FIGS. 1 and 2 in relation to the effect of frequency and current on coating weight.
Figure 3B:
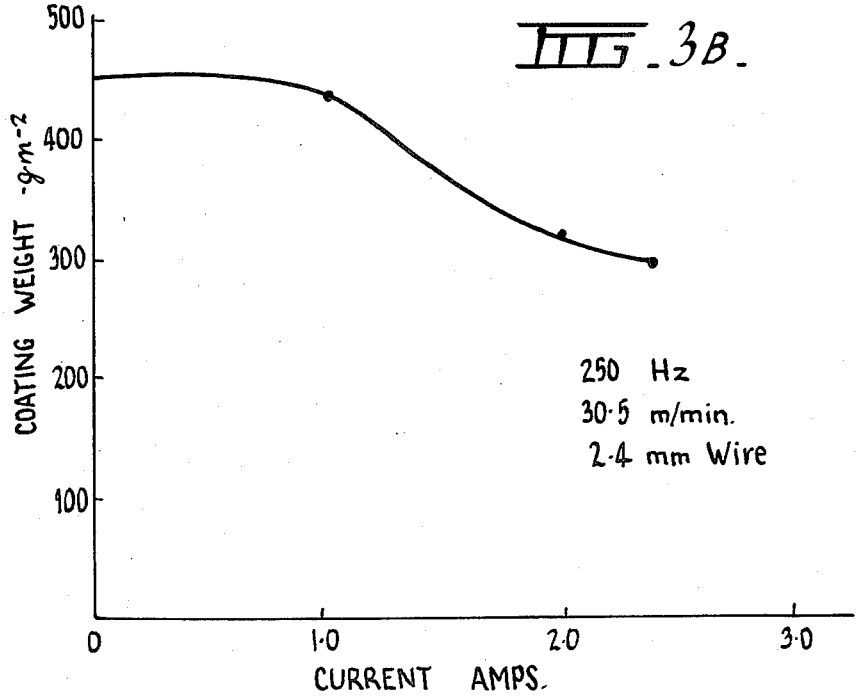

The results of the trial are presented in graphical form in FIGS. 3A and 3B.

The curves in FIGS. 3A and 3B were derived from a trial on a 2.4 mm diameter wire and wire velocity of 30.5 m $min^{-1}$, with the E.M.D. immersed 25 mm as measured from plate (16) in FIG. 2 to the bath surface. The curves show a distinct change in coating weight with both frequency and current. Current has been taken as a convenient measure of power. Whilst several families of such curves can be compiled for various E.M.D. positions, wire size, wire velocity and the like it will be apparent from the above results that the E.M.D. is capable of exerting control over the molten zinc coating on a moving wire.

Figure 4:
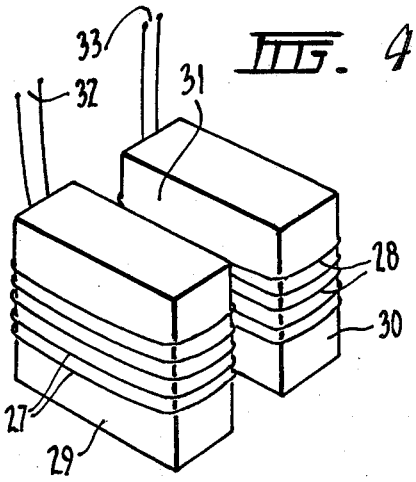
FIG. 4, is a schematic representation of the essential elements of an alternative form of E.M.D.
Figure 5:
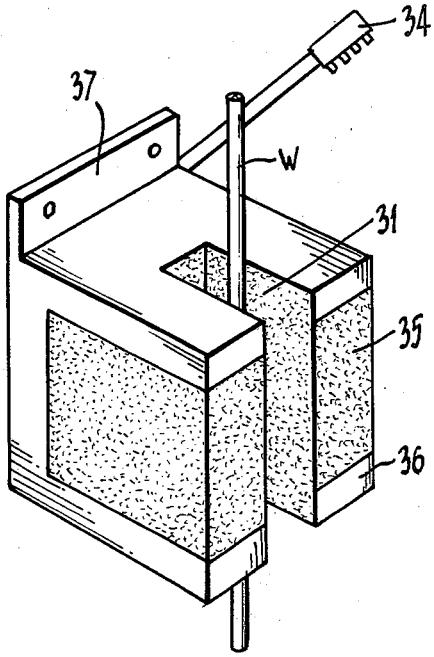
FIG. 5, is a perspective view of a practical form of the E.M.D. of FIG. 4.

In another form of E.M.D. a means of controlling the coating without having the moving wire captive is provided. FIG. 4 shows the essential elements of such an E.M.D. which consists of two coils 27 and 28 wound on two laminated ferromagnetic cores 29 and 30 to form a parallel sided gap 31 between them. The leads 32 and 33 are connected by a convenient means, for example, plug 34 shown in FIG. 5 to a power source which allows frequency and current to be varied. A practical form of the E.M.D. is shown in FIG. 5. The coils are encapsulated in insulating ceramic material 35 and set in a steel case 36 provided with mounting bracket 37. The positioning of the device may be achieved through a system similar to that shown in FIGS. 1 and 2. The device is conveniently positioned so that it is partially immersed in the molten metal bath and the wire W passes upwardly through gap 31.

In trials conducted with the E.M.D. of FIGS. 4 and 5, the coils 27 and 28 were provided with 180 turns each, a wire 2.4 mm in diameter advancing at 30.5 m $min^{-1}$ was shown to subject the coating to a wiping action. With the emergent zone protected by oiled charcoal, a zinc coating of 583 g $m^{-2}$ was entrained. However, when the E.M.D. was supplied with 5.0 amps at 400 Hz the coating weight was lowered to 391 g $m^{-2}$ and with an additional increase in current to 7.0 amps there was a further reduction in coating weight to 329 g $m^{-2}$.

Figure 6:
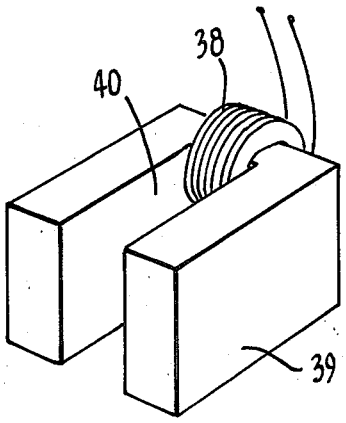
FIG. 6, is a schematic representation of the essential elements of a further alternative form of E.M.D.
Figure 7:
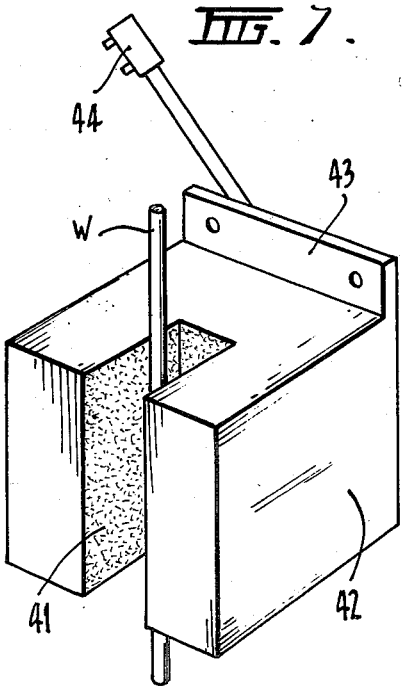
FIG. 7, is a perspective view of a practical form of the E.M.D. of FIG. 6.

In yet another form of the invention as shown in FIG. 6, a single coil 38 is mounted on a laminated ferromagnetic core 39 with a gap 40. A practical form of this form of the E.M.D. is shown in FIG. 7. Excitation of the coil generates in the gap 40 a flux that will be essentially normal to the wire W shown in FIG. 7. The coil and core assembly is encapsulated in insulating ceramic material 41 and then encased in a protective steel case 42 to which is attached a mounting bracket 43. Variable frequency, variable current power is conveniently introduced to the coil via plug 44.

In trials conducted with the form of the E.M.D. of FIG. 6 in which the coil was provided with 180 turns, it was found that the zinc coating on the wire W was subjected to a wiping action. In the trials the device was partially immersed in the molten zinc bath and the emergent zone was protected by a layer of oiled charcoal.

With a 2.4 mm wire advancing at 30.5 m $min^{-1}$ a coating weight of 536 g $m^{-2}$ was obtained. However, when the E.M.D. was supplied with 3.0 amps at 400 Hz a reduction in coating weight to 420 g $m^{-2}$ was achieved.

It has been observed that, when using the invention, protection from oxidation of the surface of the molten metal bath in the withdrawal zone and the surface of the molten metal coating on the wire is advantageous and is therefore preferred. The protection may be provided by means of a particulate bed or layer on the surface of the molten bath.

Preferably, an atmosphere is also provided adjacent the surface of the bath to eliminate, or prevent the formation of, substantial amounts of oxidised products.

Preferably said atmosphere adjacent the surface of the bath is adjusted to establish conditions which favour the formation of a thin coherent surface film to stabilise the coating.

Alternatively a separate specially prepared atmosphere is provided above the surface of the bath adjacent the point where the coating has reached its final thickness, which favours the formation of a thin coherent surface film to stabilise the coating.

This preferred form of the invention involves the use of an apparatus for putting the method into effect, which apparatus comprises a jacket adapted for positioning adjacent the surface of the bath for confining said particulate bed or layer.

Preferably the jacket incorporates means to introduce said anti-oxidising atmosphere.

Preferably the jacket also incorporates means to introduce said separate specially prepared atmosphere to stabilise the coating.

One preferred form of the invention incorporating these provisions will now be described with reference to FIG. 8 of the accompanying drawings which shows a general perspective view of the apparatus with part of the walls thereof broken away to show the interior construction.

Figure 8:
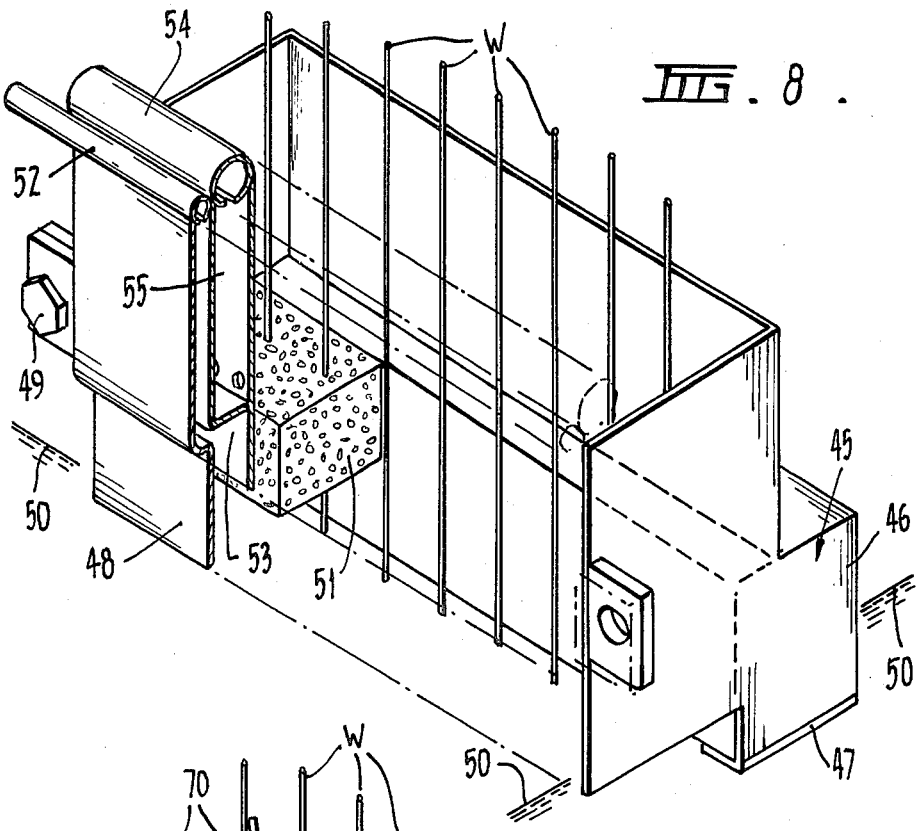
FIG. 8, is a general perspective view of a multi-wire apparatus with part of the walls thereof broken away to show the interior construction.

Referring to FIG. 8 of the drawings, there is shown an apparatus for cooperation with a plurality of wires W emerging from a bath of molten metal, which apparatus incorporates an electromagnetic device 45 which is encapsulated in a suitable ceramic and subsequently mounted in a steel casing 46 and supported on the bearers 47. The steel casing 46 extends upwardly and forwardly to form three sides of a gas box wherein the coated wire surface can be protected and conditioned during, and immediately following, withdrawal from the molten metal bath. The front of the gas box is closed by a removable cover 48 which is clamped in place by the securing bolts 49.

The unit is situated in the preferred position whereby the electromagnetic device 45 is partially immersed in the molten metal as shown by the bath level 50 and the geometry of the sides and front of the gas box is adjusted so that the bath metal provides a gas seal at the bottom of the gas box. Longitudinally, the unit is positioned so that the wires W emerge vertically parallel, and close to, say 5–10 mm distant from the face of the device 45.

On the surface of the molten metal bath within the gas box there is provided a layer of granular material 51 which preferably should be:

(a) non-wettable by the molten bath metal;
(b) about 3–6 mm in size;
(c) about 0.9–2.5 in specific gravity;
(d) substantially unreactive with the molten bath metal;
(e) substantially unreactive with the gas atmosphere used, and
(f) substantially unaffected by the temperature of the bath, and which could be crushed wood charcoal, carbon granules, crushed carbon, coke, vermiculite or similar materials.

The front cover 48 is so constructed that it provides delivery manifolds and distribution means for two separate gas systems. The first gas is introduced evenly across the width of the unit at slightly above the molten metal surface. This is done through the delivery manifold 52 and the distribution chamber 53 and the gas used may be any gas which is non-oxidising and substantially unreactive with the molten metal. Typically, such a gas could be butane, propane, natural gas, nitrogen, nitrogen+5% hydrogen, town gas or any similar gas.

The second gas is introduced evenly across the unit just above the layer of granular material through the delivery manifold 54 and the distribution chamber 55. This gas consists of a mixture of a non-oxidising gas, which may or may not be the same as the first gas, but which should have generally similar properties, and a gas which contains or provides the (−S) sulphide radical. The gas which provides the sulphide radical is preferably hydrogen sulphide ($H_2S$) but may also be carbon disulphide, dimethyl disulphide or various mercaptans (which will decompose to provide $H_2S$) or any similar gas.

As stated previously the function of the first gas is to provide an atmosphere which will maintain the bath surface at the withdrawal area in a substantially clean condition so that a consistent withdrawal can be achieved. The second gas provides an environment which encourages the formation of a stabilizing film on the surface of the coating on the wire so that a smooth surface is retained until the coating can be solidified.

An alternative procedure is to use the normal layer of oiled charcoal in the gas box and to provide only the second gas above the layer of charcoal.

The purpose of the layer of granular material is threefold.

1. To assist in the uniform and rapid dispersal of gas. (Note: This could be achieved by the use of mechanical baffles built into the gas box but this is less convenient).

2. To substantially reduce the downwards passage of oxygen or other contaminant to the molten metal bath surface.
3. To assist in maintaining a clear bath surface in the withdrawal area.

It is of interest to note that although layers of charcoal are commonly referred to in wire galvanising as "wiping beds", our experiments have shown that they do not in fact contribute anything to the wiping or removal of zinc from the coated wire surface, and they do not perform any such action in the equipment of the present invention. If, however, some additional mechanical wiping is desired in this present case, it could be appropriate to replace the charcoal or similar granules with a layer of granules of gravel, alumina, crushed ceramic or other material which would be known to any persons skilled in the art.

Figure 9:
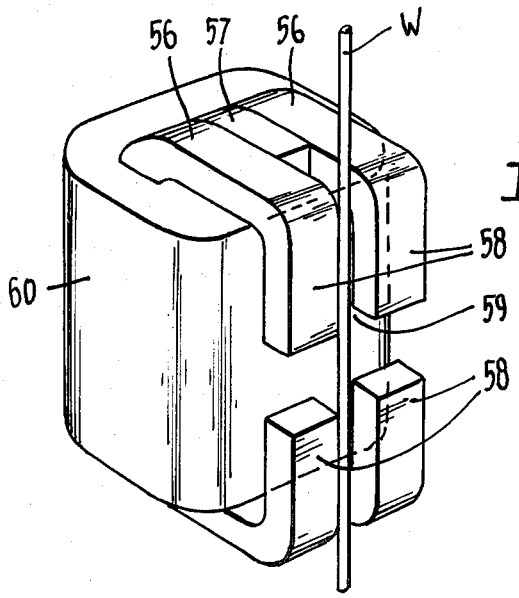
FIG. 9, is a schematic representation of the essential elements of another alternative form of E.M.D. in which the wire runs in grooves cut in the core.

A further preferred form of electromagnetic device suitable for use in the present invention, that is applicable to a single wire operation, is shown in FIG. 9.

As shown this device incorporates two laminated steel cores 56 having steel spacers 57 interposed therebetween. Each core 56 incorporates extended opposed lug portions 58, with the lug portions 58 of the respective steel cores 56 defining therebetween a vertically extending passage 59 up through which the coated wire W passes. The combination of laminated steel cores 56 and spacers 57 are surrounded by a winding 60 as shown.

Figure 10:
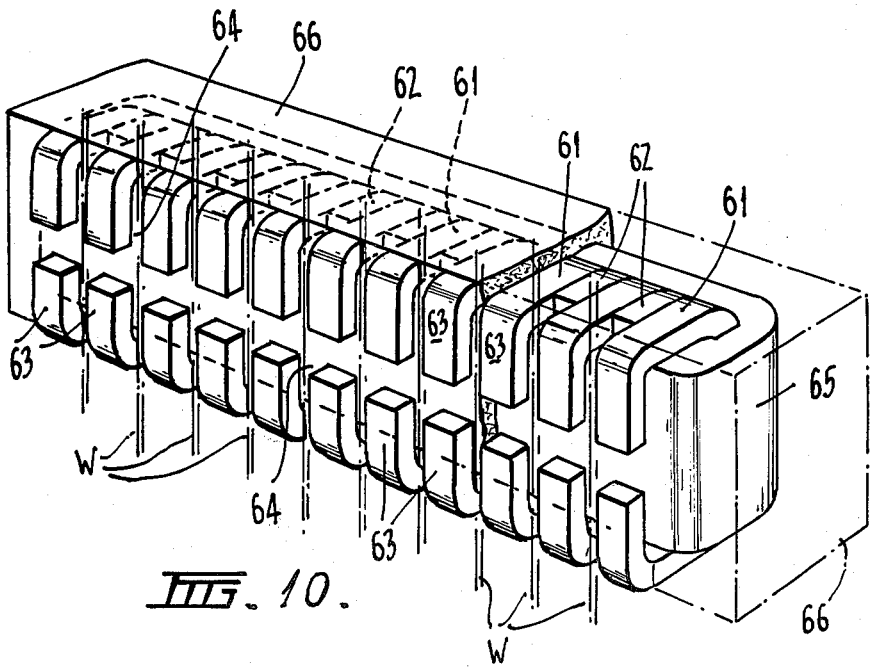
FIG. 10, is a multi-wire device that is essentially an extension of the single wire device of FIG. 9 to provide 10 vertically extending passages.

FIG. 10 of the accompanying drawings shows a device for cooperating with a plurality of wires W emerging from a bath of molten metal and referred to as a multi-wire device, and in the particular embodiment illustrated is a ten-wire device. The multi-wire device of FIG. 10 is essentially an extension of the single wire device of FIG. 9, to provide 10 vertically extending passages. The device comprises 11 laminated steel cores 61 with interposed laminated steel spacers 62, and opposed laminated lug portions 63, which define the vertically extending passages 64 through which the coated wires W pass. A single winding 65 is provided around the bundle of cores 61 and spacers 62, and the whole combination is encapsulated within a protective ceramic casing 66 (shown in phantom lines in FIG. 10) with only the lug portions 63 exposed and extending from the side thereof.

Figure 11:
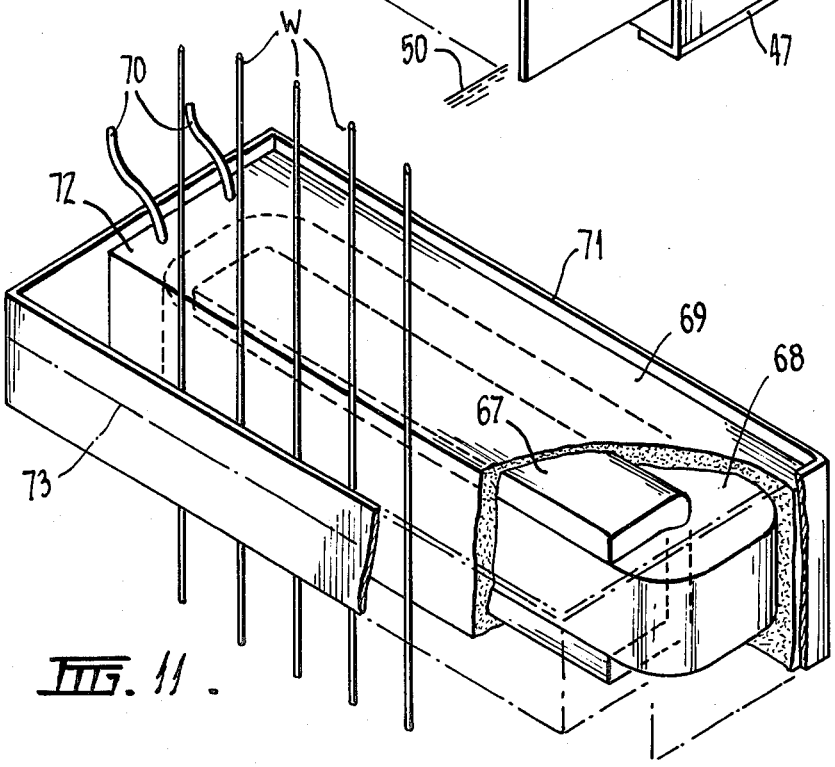
FIG. 11, of the accompanying drawings illustrates a further embodiment of an electromagnetic device for use in the present invention and although applicable to the controlling of coating weight on wire is also applicable to coating weight control on elongated strip material.

FIG. 11 of the accompanying drawings illustrates a further embodiment of an electromagnetic device for use in the present invention, and although applicable to the controlling of coating weight on wire, is also applicable to coating weight control on elongate strip material.

The embodiment of FIG. 11 is essentially similar to that of FIG. 10 with the exception that the laminated steel cores, generally indicated as 67, are not provided with opposed lug portions as shown in FIG. 10, but terminate approximately adjacent the outer surface of the winding 68, whilst the whole combination of cores and winding is encapsulated within a protective ceramic casing 69, with the leads 70 to the power supply protruding from the casing 69 as shown. The unit is encased within a low silicon steel enclosure 71 which provides a passage 72 for the wires W.

In this embodiment, the device is immersed partially or wholly below the zinc surface shown as 73.

The embodiment of FIG. 11 is particularly applicable to the control of the coating weight on elongate strip or the like, in which situation two devices of the type shown in FIG. 11 (with the enclosure 71 removed) are positioned on either side of the strip adjacent the opposite faces thereof to control the coating weight on the respective faces. In such a situation the enclosure 71 may be arranged to surround the entire combination of the two devices to define the ends of the passage therebetween for the strip material.

In a further trial, involving galvanized 2.4 mm steel wire, a device similar to that shown in FIGS. 1 and 2 of the drawings was used, involving a 33 turn coil on a tube having a 20 mm bore using insulated 2.8 mm copper wire. The whole assembly was encapsulated to yield a device of dimensions 60 mm × 60 mm. The device was mounted so that 14 mm was immersed in the zinc. The emergent conditions were controlled with oiled charcoal. At a frequency of 14.6 KHz with a current of 50 amps. and a wire speed of 30.5 m/min an average coating weight of 203 g/m was achieved.

The actual frequency and current chosen for any particular coating operation will depend on the wiping efficiency required and the final coating weight. Frequencies beyond those discussed in the above example, where 14.6 KHz was used, are feasible within practical and economic limits.

We claim:

1. A method of controlling the coating of a wire, strip, mesh or the like, emerging substantially vertically from molten metal baths, comprising subjecting said wire, strip, mesh or the like to an alternating electromagnetic field generated by single phase alternating electric current supplied to an electromagnetic device which is at least partially immersed in the bath, said field being applied at or below the point of emergence of the wire, strip, mesh or the like from the molten metal bath with the point of emergence of said wire, strip, mesh or the like being within the electromagnetic field to thereby control the coating weight per unit of area.

2. A method as claimed in claim 1, in which the frequency of the alternating electromagnetic field is not less than 20 Hz.

3. A method as claimed in claim 1, in which the coating weight is adjusted by controlling the frequency of the alternating electromagnetic field.

4. A method as claimed in claim 1, in which the coating weight is adjusted by controlling the current used to generate the alternating electromagnetic field.

5. A method as claimed in claim 1, in which the generated alternating electromagnetic field is essentially parallel to the moving wire, strip, mesh or the like.

6. A method as claimed in claim 1, in which the generated alternating electromagnetic field is essentially transverse to the moving wire, strip, mesh or the like.

7. A method as claimed in claim 1, in which the wire, strip, mesh or the like being coated passes through means for generating said electromagnetic field.

8. A method as claimed in claim 1, in which the wire, strip, mesh or the like being coated passes outside but in close proximity to the device for generating said electromagnetic field such that the wire passes through regions of high flux density.

9. A method as claimed in claim 1, in which the coated wire, strip, mesh or the like is protected by a neutral or reducing atmosphere supplied to a chamber open at both top and bottom which has its bottom edge immersed in the molten metal bath, and which incorporates the device for generating said electromagnetic field and surrounds the area where the wire, strip, mesh or the like being coated emerges from the molten metal bath.

10. A method as claimed in claim 9, in which the emergence area is covered with particles inert to the environment.

11. A method as claimed in claim 1, in which the emergence area is covered with a bed of oiled charcoal or similar material enclosed in a chamber open at both top and bottom which has its bottom edge immersed in the molten metal bath, and which incorporates said electromagnetic device.

12. A method as claimed in claim 9, in which a small amount of gas or vapour, which contains or which will decompose to produce a sulphide (−S) radical, is supplied to the protective atmosphere either directly or as an addition to the neutral or reducing gas.

13. A method as claimed in claim 9, in which a gas or vapour which contains or will decompose to produce a sulphide (−S) radical is supplied within the chamber after the molten coating has achieved its final thickness.

* * * * *